United States Patent [19]

Ollington

[11] Patent Number: 4,575,085

[45] Date of Patent: Mar. 11, 1986

[54] CASINO GAME

[76] Inventor: Lionel V. Ollington, 185 Canterbury Rd., St. Kilda West, Victoria 3182, Australia

[21] Appl. No.: 527,791

[22] Filed: Aug. 30, 1983

Related U.S. Application Data

[63] Continuation-in-part of Ser. No. 486,939, Apr. 20, 1983, abandoned.

[30] Foreign Application Priority Data

Feb. 10, 1983 [AU] Australia ..... PF7972

[51] Int. Cl.[4] ..... A63F 5/00

[52] U.S. Cl. ..... 273/138 R

[58] Field of Search ..... 273/138 R, 144, 145, 273/148 R, 402

[56] References Cited

U.S. PATENT DOCUMENTS 2,104,375 1/1938 Perry ..... 273/148 R 3,175,826 3/1965 Davis ..... 273/145 R

OTHER PUBLICATIONS

Scarne, John; Scarne's Encyclopedia of Games; 1973; Two-Up, pp. 571–573.

Scarne, John; Scarne's Complete Guide to Gambling; 1961, pp. 203–205 & 234–242.

Scarne, John; Scarne's New Complete Guide to Gambling; 1974; pp. 18–21.

*Primary Examiner*—Paul E. Shapiro

*Attorney, Agent, or Firm*—Larson and Taylor

[57] ABSTRACT

A casino game of two-up or the like in which the total number of players is restricted and the players purchase their position in the ring by making a time-based payment, the house making no charge other than this payment. The game also includes a possibility that players bet against the house and the return to the players is based on betting that either two heads or two tails will be uppermost or, alternatively, not only on two heads and two tails being uppermost but also on mixed heads and tails; in either case the odds are adjusted so that over a period the house receives a predetermined percentage of the total amount wagered. The game has a ring within which the spinner stands and above which there is an obstruction which, when struck by the coins, causes them to spin.

3 Claims, 3 Drawing Figures

CASINO GAME

CROSS REFERENCE TO RELATED APPLICATION

This application is a continuation-in-part of application Ser. No. 486,939, filed on Apr. 20, 1983, and now abandoned.

FIELD OF THE INVENTION

This invention relates to a casino game and, in particular, to a casino adaptation of the game commonly called "two-up".

BACKGROUND OF THE INVENTION

The object of the game two-up is for a spinner to spin two coins so they both land with a "head" uppermost and the spinner enters a bet which is covered by one of the other players. Other participants, and the spinner, can also enter side bets against each other on whether the coins will fall "heads" or "tails". In this game, if one coin falls heads and the other tails, there is no result and the coins are re-spun. Whilst in this specification I shall refer to coins having heads or tails, it is to be understood that any flat token, preferably circular, having differentiable markings on opposite sides can be used.

During the period whilst he is spinning, the spinner can, before each spin, withdraw some of the money which is held by the house.

In this conventional game, where a spinner spins three heads in a row, the house takes 10% of all money bet on the particular spin.

There have been proposed modifications of this game, for example that used in Australian casinos, where the spinner must spin three heads consecutively, or spaced by mixed heads and tails, before he can withdraw any of the money won. In this game, if mixed heads and tails are spun five times consecutively, all money in the ring is lost.

Both of these games have disadvantages as far as the players and the appropriate licensing authorities are concerned, the disadvantage in the first game being that it is necessary for the house commission to be taken from bets standing in the ring and the second, which is basically a disadvantage to the players, is that the whole of their bets can be lost on an unsuccessful run of mixed heads and tails.

A further disadvantage is that, in order for the game to maintain the attention of the players and to be exciting, it is necessary that the coins, which are thrown from a "kip", a flat piece of board held in the spinner's hand, should spin satisfactorily so the result is in doubt when the coins strike the floor of the ring. To do this takes a skill which is often not possessed by a novice.

SUMMARY OF THE INVENTION

It is the principal object of the invention to provide modified forms of two-up which are particularly suitable for casinos, in which the house commission is achieved simply and without inconvenience to the players.

It is a second object of the invention to provide a ring in which the coins strike an obstruction after leaving the kip to ensure that they spin satisfactorily.

In the first form of game the number of players in a ring is restricted to a predetermined number and they purchase their position in the ring by making a time based payment. Once in the ring, they can bet against each other or against the house.

In the modified form of game which is played against the house the return to the players is based on betting that either two heads or two tails will be uppermost or, alternatively, not only on two heads or two tails, but also on mixed heads and tails. In another case, the odds are adjusted so that the house receives, over a period, a percentage of the total amount wagered.

The invention also includes a casino game of two-up comprising a ring within which a spinner stands and outside which the other players are located and an obstruction located above at least portion of the ring, which obstruction is adapted to be struck by the coins to be thrown by the spinner to ensure that these are caused to spin.

BRIEF DESCRIPTION OF THE DRAWINGS

In order that the invention may be more readily understood, particular forms of the invention will be described in relation to the accompanying drawings, in which.

DESCRIPTION OF THE PREFERRED EMBODIMENTS

Figure 1:
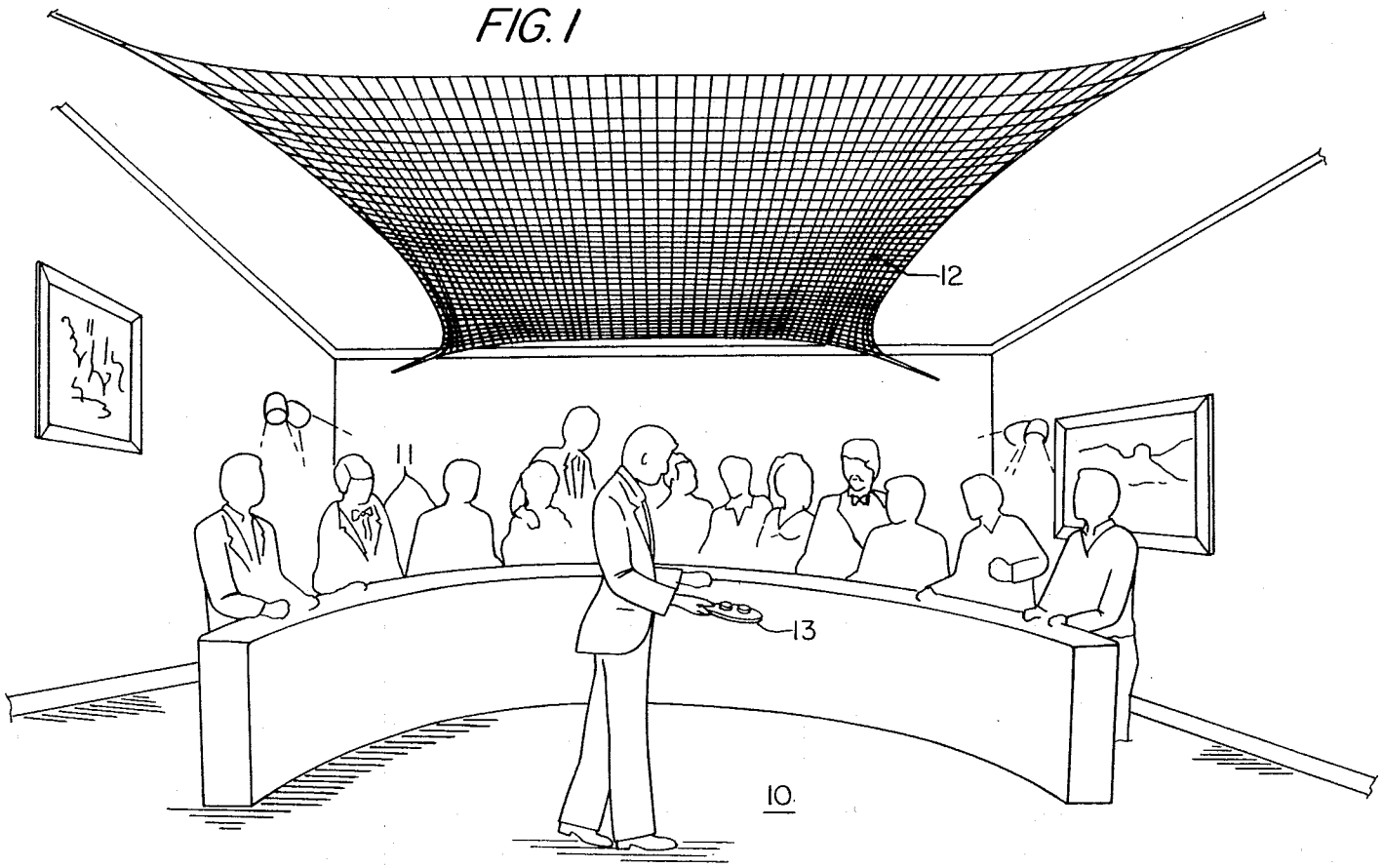
FIG. 1 is a view of a first form.

The preferred form of ring is illustrated in FIG. 1.

The ring 10 must be of such a size as to provide freedom of movement of the spinner, the player who is spinning the coins, and the assistant or assistants who are running the game. It must also be of such a size as to permit coins spun into the air to land freely within the ring, even if they are not spun directly upwardly.

Also, the size of the ring determines the number of other players which can be located close to its periphery to be able to satisfactorily watch the game.

It is to be understood that the players do not need to be directly adjacent the periphery of the ring, although this is preferable.

Referring to FIG. 1, the ring 10 is substantially circular, but could be of any other required shape, and is surrounded by a viewing space 11 in which players can either stand or be seated.

Located above the ring there is a mesh 12, which is preferably a taut wire mesh having a mesh spacing of, say, 2 inches, the spacing being sufficient to permit relatively easy passage of the coins being used, which may be approximately 1 inch in diameter, but of such a size that there is a high likelihood that the coins will strike portion of the mesh, either on their passage up or down through the mesh, to thereby impart a spin to the coins.

The coins are placed on a kip 13, which is a relatively flat piece of wood or other material, and an experienced spinner can, by twisting his wrist at the time of throwing the coins, cause them to spin through the air but a novice or unskilled spinner often finds that the coins float so that they spin little, if at all.

By providing the mesh 12, I ensure that the coins spin satisfactorily so that it is not possible to anticipate how the coins will land when they strike the floor of the ring 10.

If, as may happen, a coin becomes lodged on the upper surface of the mesh 12, a rule may be made that the coin can be dislodged, say by striking the mesh with ball or the like, and that the coin, after falling to the ground can either, by definition, complete the spin or cause a no-spin so that the spin is to be repeated.

Figure 2:
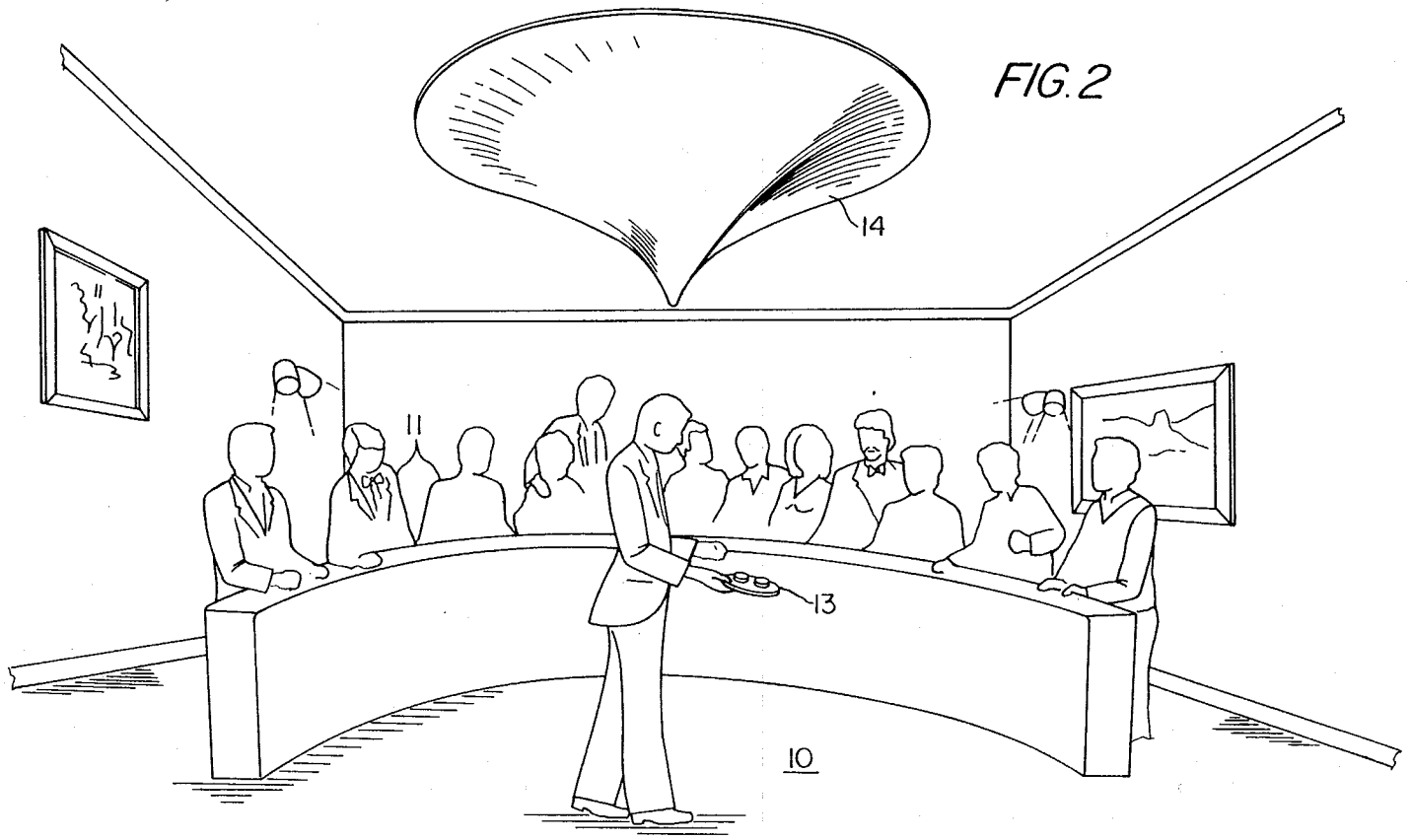
FIG. 2 is a view of a second form.

In a modified form of the ring, shown in FIG. 2, instead of the mesh 12, I provide an outwardly flared conical member 14, the centre of which lies above the centre of the ring.

This member may be made of a hard material or of a fabric which is drawn relatively taut so that, on their passage, the coins tend to strike this member obliquely and this will ensure that a spin is given to the coins.

Figure 3:
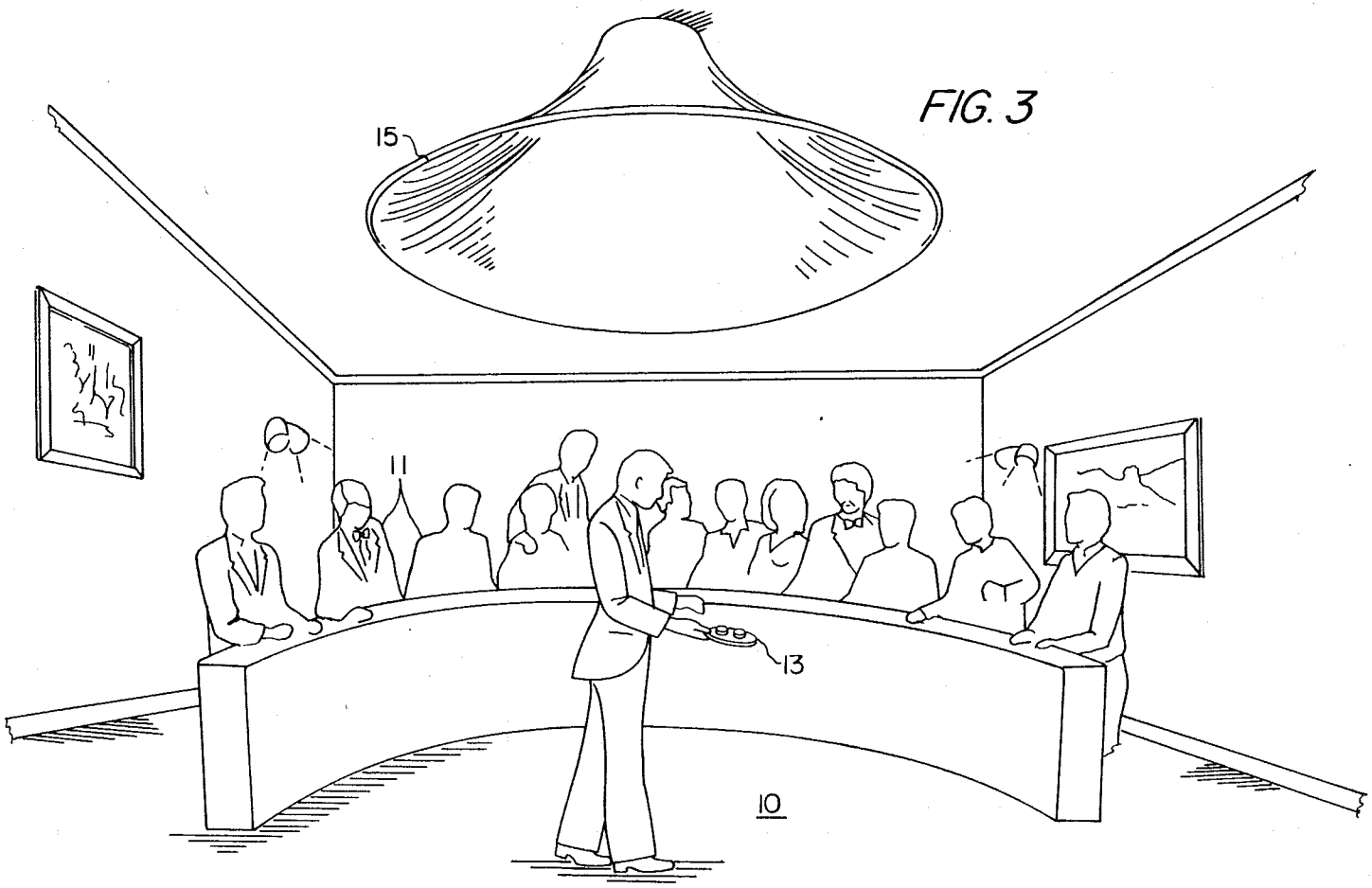
FIG. 3 is a view of a third form.

In a second modified form, illustrated in FIG. 3, there is an open flared conical member 15, the centre of which lies above the centre of the ring. In this embodiment the coins are thrown to the inner surface of the cone and, on striking this obliquely, they are caused to spin.

Whilst in the embodiments of the Figures I have shown particular forms of obstructions which can cause the coins to spin, it is to be understood that these are purely exemplary and are not essential to the invention, in its broad sense.

In the first form of game I would anticipate providing, say, fifty chairs for players about the ring and with the spinner being a person from one of the chairs.

Each player would pay a predetermined amount for the occupancy of a chair for a particular time and this one-off payment would provide the whole payment to the house.

The game can then be played in a completely conventional manner with the spinner receiving the normal odds of even money if he spins heads and losing should he spin tains.

A mixed spin of one head and one tail leaves the status quo and a further spin is effected.

As far as side bets are concerned, these are made between the various players, including the spinner, if he so requires, or between the players and the house.

The only differences from the conventional game is that the game is not disrupted after three consecutive spins of heads, as the house does not take commission in this way.

Whether he is betting on heads or tails, the spinner remains spinning until he spins tails.

It will be seen that, if the cost to join the game way, say, $20.00 per hour and there were fifty players, the house's commission would be $1,000.00 per hour, or some $8.75 million per year if the game were played at full capacity, twenty-four hours per day.

In a second form of modification the game is played against the house and is arranged for the house to pay on either two heads or two tails being spun or on two heads or on two tails or one head and one tail being spun.

In this form of game the odds are arranged to ensure that, over a period, the house receives a percentage of the monies bet.

If the betting is on only heads or tails, the house payout would normally be 9:10, over a period a house take of 10%. The odds can be varied as required. This form of game can add to the suspense as, each time one head and one tail is thrown, there are no successful, or no losing, bettors.

In one particular form where a payout can be made on heads, tails or mixed spin, the arrangement can be a 2:1 payout for players correctly selecting heads or tails and a 4:6 payout for those correctly selecting mixed heads and tails.

On such an arrangement, in the long term, the house's take would be approximately 25% and there would, again, be no other house commission paid.

In such forms of game the amount received by the house would not be as predictable as in the first form, but it would, nevertheless, provide a satisfactory game for players and, again, would avoid any disruption through the necessity of taking a house percentage after predetermined events or at predetermined times.

In this form of the game it would be possible to provide, from the house commission, a certain percentage for a jackpot. This jackpot could be payable on a certain, rare, combination of spins, such as, for example, seven heads in a row without any intervening odds. As the jackpot mounts, it will be appreciated that the players will be drawn to play the game with the hope that they could succeed in winning the jackpot.

It will be understood that certain modifications can be made in these new variations of the game, particularly in the odds offered, provided such modifications are such as to permit the game to be readily controlled without disruption, whilst, at the same time, giving a pleasurable game to the players.

I claim:

1. A casino game of two-up comprising: a ring structure within which a spinner stands and outside which other players are located; and an obstruction located above at least a portion of the interior of the ring structure which obstruction is adapted to be struck by the coins to be thrown by the spinner to ensure that these are caused to spin, said obstruction being relatively fully viewable from any location adjacent the outside of said ring structure and wherein the obstruction is in the form of a mesh having apertures therethrough which are of a sufficient size to pass the coins but of a size so that the coins will strike the edges of the mesh, either when passing upwardly or downwardly therethrough, to ensure that the coins are caused to spin.

2. A casino game of two-up comprising: a ring structure within which a spinner stands and outside which other players are located; and an obstruction located above at least a portion of the interior of the ring structure which obstruction is adapted to be struck by the coins to be thrown by the spinner to ensure that these are caused to spin, said obstruction being relatively fully viewable from any location adjacent the outside of said ring structure, wherein the obstruction is of a form such that coins thrown vertically will strike the obstruction at an angle to ensure that the coins are caused to spin, and wherein the obstruction is an upwardly directed, outwardly extending conical member.

3. A casino game of two-up comprising: a ring structure within which a spinner stands and outside which other players are located; and an obstruction located above at least a portion of the interior of the ring structure which obstruction is adapted to be struck by the coins to be thrown by the spinner to ensure that these are caused to spin, said obstruction being relatively fully viewable from any location adjacent the outside of said ring structure, wherein the obstruction is of a form such that coins thrown vertically will strike the obstruction at an angle to ensure that the coins are caused to spin, and wherein the obstruction is a downwardly directed, openly flared conical member.

* * * * *